US008808502B1

(12) United States Patent
Hunter et al.

(10) Patent No.: US 8,808,502 B1
(45) Date of Patent: Aug. 19, 2014

(54) SUBSTRATE TREATMENT PROCESSES

(71) Applicant: Xerox Corporation, Norwalk, CT (US)

(72) Inventors: Jonathan B Hunter, Marion, NY (US); George A Gibson, Fairport, NY (US); Linn C Hoover, Webster, NY (US); Yuanjia Zhang, San Jose, CA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/853,833

(22) Filed: Mar. 29, 2013

(51) Int. Cl.

| | |
|---|---|
| ***D21H 17/14*** | (2006.01) |
| ***D21H 17/65*** | (2006.01) |
| ***D21H 19/12*** | (2006.01) |
| ***D21H 23/22*** | (2006.01) |
| ***D21H 23/50*** | (2006.01) |
| ***D21H 23/52*** | (2006.01) |
| ***D21H 23/54*** | (2006.01) |
| ***D21H 23/56*** | (2006.01) |
| ***D21H 25/02*** | (2006.01) |

(52) U.S. Cl.
CPC ..... *D21H 25/02* (2013.01)
USPC ..... 162/181.1; 162/158; 162/184; 252/79.2; 428/32.18

(58) Field of Classification Search
USPC ..... 162/158, 164.1, 181.1, 184; 252/79.1–79.4; 428/32.1, 32.18, 32.31
See application file for complete search history.

(56) References Cited

U.S. PATENT DOCUMENTS

| | | | | |
|---|---|---|---|---|
| 1,951,076 | A * | 3/1934 | Wood | 106/287.24 |
| 2,792,841 | A * | 5/1957 | Larson | 131/342 |
| 3,562,099 | A * | 2/1971 | Sheppard et al. | 162/135 |
| 3,640,285 | A * | 2/1972 | Briskin et al. | 131/365 |
| 5,421,526 | A * | 6/1995 | Johansson et al. | 241/20 |
| 2007/0113997 | A1 * | 5/2007 | Glittenberg | 162/175 |
| 2010/0279078 | A1 * | 11/2010 | Pan et al. | 428/195.1 |

FOREIGN PATENT DOCUMENTS

| | | | | |
|---|---|---|---|---|
| JP | 2005279982 | A * | 10/2005 | B41M 5/00 |
| JP | 2007138339 | A * | 6/2007 | |
| SU | 1461641 | A * | 2/1989 | |
| SU | 1628697 | A * | 4/1993 | |

OTHER PUBLICATIONS

Derwent Abstract of Ivkova et al (SU 1628697 A1), 1994.*
Derwent Abstract of Ivkova et al (SU 1461641 A1), 1989.*
"Weak Acids—Titration of Acetic Acid", University of Washington Dept. of Chemistry, [online], No Date, [retrieved from the Internet] retrieved Feb. 21, 2014, <URL: http://depts.washington.edu/chem/facilserv/lecturedemo/pHofAceticAcid-UWDept.ofChemistry.html>.*
"Table of Acids with Ka and pKa values", Univ. of California, Santa Barbara, [online], No Date, [retrieved from the Internet] retrieved Feb. 21, 2014, <URL: http://clas.sa.ucsb.edu/staff/Resource%20folder/Chem109ABC/Acid,%20Base%20Strength/Table%20of%20Acids%20w%20Kas%20and%20pKas.pdf>.*
"Tannic Acid", product information sheet, Post Apple Scientific, Inc., 2 pages, [online], No Date, [retrieved from the Internet] retrieved Feb. 22, 2014, <URL: http://tannicacid.info/>.*
J. Peel, Paper Science & Paper Manufacture 1999, pp. 18-19.*
Smook, Gary A., Handbook for Pulp and Paper Technologists, 2nd ed, Angus Wilde Publications, 1992, pp. 225 and 286-288.*

* cited by examiner

*Primary Examiner* — Dennis Cordray
(74) *Attorney, Agent, or Firm* — Eugene O. Palazzo

(57) ABSTRACT

A process where substrates, such as documents like smooth coated papers, are exposed to a weak acid, a weak acid solution, or mixtures thereof for the purpose of increasing the surface roughness of the substrate.

18 Claims, No Drawings

SUBSTRATE TREATMENT PROCESSES

This disclosure is generally directed to substrates, such as documents, treatment processes, and where the substrates are exposed to at least one of a weak acid and a weak acid solution.

BACKGROUND

Many suitable substrates, such as paper, that can be selected for utilization in xerographic imaging apparatus, ink jet printing systems, inclusive of solid ink jet processes, are known. These substrates, systems, and processes enable the generation of developed images with, in many instances, high image quality. However, a disadvantage that may result when using certain substrates, especially in solid ink jet printing processes, is related to consistently achieving excellent print robustness. The aforementioned disadvantage can be present with several smooth coated papers, or uncoated papers, where the ink may have limited opportunities to form a strong mechanical link with the paper, and where certain inks can be removed from coated papers by hand rubbing or scratching by devices like blades. Although several processes have been tested to improve the image and ink robustness, there continues to remain situations where the robustness of solid ink jet images can be improved.

When substrates, such as coated papers, are printed with ink jet printing inks and dried, the inks may in some instances later migrate from their original locations on the coated substrate, thereby resulting in unsatisfactory images. This migration is known as bleed or bloom, and is especially noticeable under conditions of high temperature and high humidity, such as for example, 35° C. and 80 percent relative humidity.

Also, undesirable low wet smear resistance for images obtained with selected ink jet printing processes is another disadvantage. Wet smear resistance refers, for example, to the ability of ink jet printing papers to resist smearing when the ink jet printed and dried substrate are disturbed, such as by being rubbed in the presence of moisture.

Printing systems where solid ink jet technology (SIJ) economically produces vibrant images on relatively inexpensive paper are known. The solid ink utilizes the phase changing characteristics of the incorporated wax to achieve excellent image quality, and in some instances with the ink remaining at the surface of the paper. As a result there are instances, especially with certain solid inks, where there is a tendency for the ink to be rubbed off or removed by scratching from coated papers, and where the ink may not be sufficiently secured to the paper substrate. Many different processes and coated papers have been tested for image robustness, however, very few, if any, have proven to be successful for extended time periods. It is also known that there is a general relationship between paper surface roughness and image robustness as demonstrated with the Trevakosji paper.

There is a need for documents that substantially avoid or minimize the disadvantages of a number of known substrates.

Also, there is a need for imaging systems, inclusive of ink jet printing processes that permit improved image and ink robustness.

Further, there is a need for solid ink jet systems where the images developed on substrates, such as coated papers, retain their permanency over extended time periods and have increased image robustness with various media and where there is accomplished jetting an acidic etching agent onto the coated paper by either a flood coating process, or in an image-wise manner to promote adhesion of the solid ink to the substrate.

Yet another need resides in providing coated papers that enable the production of vibrant solid ink jet images where the images have improved resistance to smearing and smudging for lengthy periods of time, and there is solid ink jet print durability.

Additionally, there is a need for economical and simple processes for the treatment of documents to obtain improved image and ink robustness and improvements in document characteristics, such as paper printability.

Moreover, there is a need for coated papers that allow for the substantially permanent attachment of solid ink jet inks thereto.

There is also a need for coated papers that improve the permanent attachment of solid ink jet inks thereto.

Another need resides in providing coated papers with increased image permanence and excellent gloss characteristics that increases the number of acceptable papers that can be selected for solid ink jet printing, and that utilizes present manufactured solid ink jet hardware These and other needs are achievable in embodiments with the processes and papers disclosed herein.

SUMMARY

There is disclosed a process which comprises exposing a substrate to at least one of a weak acid and a weak acid solution; a process which comprises contacting a smooth coated paper with at least one of a weak acid and a weak acid solution, wherein the weak acid is of a pH of from about 3 to about 6, and the weak acid solution is of a pH of from about 3 to about 6; and a process which comprises exposing a smooth coated paper to a weak acid or a weak acid solution, and wherein at least one of the paper binder and fillers contained in the paper of alkali metal carbonates and alkali metal oxides degrade or decompose thereby allowing permanent intercalation of a solid ink jet composition into the resulting treated paper, and wherein the pH of the weak acid is from about 3.1 to about 5.9.

EMBODIMENTS

Disclosed are processes which comprise exposing a substrate to at least one of a weak acid and a weak acid solution, and wherein at least one is 1, is from 1 to about 10, is from 1 to about 5, from 1 to about 3, or is from 1 to 2.

Processes

The treatment or the microscopically thin substrate surface modification based on acid exposure of substrates can be accomplished by exposing, contacting or treating a substrate, especially coated papers, with the disclosed suitable acids, acid solutions or mixtures thereof, where the exposing can be affected by various methods inclusive of placing the substrate in a bath, spraying the substrate, applying the acid or acid solution to the document by a device or tool, such as a blade, a roller, a patterned printing plate, or a rod; by solid ink jet apparatuses prior to the generation of developed images and prints; liquid spray coating, dip coating, wire wound rod coating, fluidized bed coating, air knife, brush, roll, electrostatic spraying, sonic spraying, and the like. Thus, for example, with a blade the acid or acid solution is rolled onto both sides of the substrate like paper, and then a flexible blade is selected to scrape away the excess acid or acid solution followed by the application of a strong blast of air to remove any acid or acid solution.

More specifically the disclosed acid exposure or treatment with a weak acid, a weak acid solution, or mixtures thereof can be accomplished in various affective manners inclusive of flood coating the substrate using the known in-line Sapphire Treatment method. Also, there can be selected for the exposing, treatment, or contacting of the disclosed substrates flow coating methods using the known Hankeler Tinter Device. Further, a patterned flexographic plate or similar patterned member can be used to apply the acid or acid solution in an image wise manner, such as applying the acid or acid solution from an ink jet head prior to development of an image. In some situations, such as where viscous inks are utilized like gel inks, and some solid phase inks, an acid or acid solution could be added to the colorless solid ink jet composition. This might take the form of an acid terminated wax or of acidic derivatives of aliphatic compounds that might be compatible with the inks waxy base, such as long chain fatty acids, and long chain sulfonic, phosphoric, or phosphonic acids.

A number of commercially coated papers and commercially smooth coated papers, such as those papers sold by International Paper, and which usually include a number of fillers or sizing additives, such as salts like calcium carbonate, calcium oxide, magnesium salts like magnesium carbonate, magnesium oxide, and the like, when exposed to weak acids, weak acid solutions, or mixtures thereof are believed to decompose the fillers or the paper binders when there is an absence of fillers, into the corresponding metals, thereby roughening up the coatings on each surface of the paper and resulting in solid ink jet robustness. For solid ink jet printing processes the weak acid or weak acid solution treatment can be accomplished in a manner that removes only those areas of the paper where the image is to be formed and developed, the remaining areas being free of the acid or acid solution treatment.

The weak acid or weak acid solution exposure of the disclosed substrates like coated papers, etches and changes the surface characteristics of the paper rendering it less smooth, and enables, for example, inks, such as solid ink jet inks to be bonded to the paper thereby avoiding ink smudging as determined by visual observation, and by the known TAPPI (Sheffield Method) testing, the known Sutherland Rub Test, and the known Parker Surface Roughness testing evaluations, and allowing excellent intercalation of and substantially permanent retention of the image and the ink into the substrate. In embodiments, the exposure of substrates to weak acids, weak acid solutions, or mixtures thereof permits solid ink jet inks to be intercalated in the substrate like coated paper, thereby improving the robustness of the inks without adversely affecting the characteristics of the substrates.

The exposure of substrates like smooth coated substrates, such as Gloss Coated and Silk Coated papers, available from a number of manufacturers, such as International Paper Company, can result in an adhesion increase of ink jet inks by increasing the tooth of the paper, that is increasing the surface roughness.

In substrates, such as coated papers that do not contain decomposable fillers, the paper binder itself can be attacked and roughened by solvent treatment with, for example, suitable solvents of acetone, methyl ethyl ketone, and the like, and then subsequently subjected to the weak acid or solutions thereof, exposures disclosed herein.

Various effective time periods can be selected for the acid or acid solution processes disclosed. Thus, for the treatment time periods, the documents can be contacted with, treated with, or exposed to a weak acid or weak acid solution for from about 1 to about 60 milliseconds, from about 1 to about 40 milliseconds, from about 2 to about 20 milliseconds, and other time periods, such as from about 1 minute to about 10 minutes, that result in the treated documents illustrated herein. When the documents like paper are treated in a machine, such as an ink jet apparatus, the machine process speed is, for example, from about 400 to about 600 feet per minute, and more specifically from about 450 to about 525 feet per minute. Slower machine speeds and more rapid machine speeds can be selected, or where the weak acid or acid solution can be applied to a document further upstream from the ink jet print heads.

Acids/Acid Solutions

Weak acid and weak acid water solutions thereof means, for example, an acid that dissociates incompletely and does not release all of its hydrogens in a solution, donating only a partial amount of its protons to the solution, that is weak and strong acids can be classified by the concentration of the H+ ions that results from ionization. These acids have a higher pKa than strong acids, which release all of their hydrogen atoms when dissolved in water.

Yet more specifically, weak acids and weak acid solutions means, for example, a weak acid or solution thereof with a pH, as measured with a pH meter of equal to or greater than about 3 to about 6, from about 3.1 to about 5.9, from about 3.3 to about 5.5, from about 3.5 to about 5.3, from about 3.9 to about 4.7, from about 4 to about 5.8, or from about 4.3 to about 5.6.

Weak acid examples selected for the processes of the present disclosure are dilute water soluble organic acids, mineral acids and a number of other known weak acids. Specific examples of weak acids that can be selected for the processes of the present disclosure are formic acid (HCOOH), acetic acid ($CH_3COOH$), trichloroacetic acid ($CCl_3COOH$), carbonic acid ($H_2CO_3$), hydrofluoric acid (HF), hydrocyanic acid (HCN), oxalic acid ($H_2C_2O4$), benzoic acid, and other water soluble weak acids, inclusive of both suitable organic and inorganic acids.

Acid solutions selected for the processes disclosed herein include any suitable acid mixed with water or other diluent to arrive at the pH ranges illustrated herein. Suitable acid examples for formation into solutions include both known organic and known inorganic acids, such as concentrated hydrochloric acid, concentrated sulfuric acid, concentrated hydrofluoric acid (HF), concentrate oxalic acid ($H_2C_2O_4$), concentrated benzoic acid, concentrated carbonic acid, mixtures thereof, and the like.

Substrates

Examples of substrates treated in accordance with the processes illustrated herein include documents, paper, smooth coated papers, calendared papers, paperboard, wood, cloth, nonwoven fabric, felt, polymers, ceramics, inclusive of glazed and unglazed ceramics, newspapers, magazines, brochures, and the like, and where permanence of the printing ink selected, such as a solid phase change ink composition, there is attained or attainable. The substrates obtained from such processes, especially the documents thereof, may be useful in electrophotographic imaging apparatuses, including digital, image on image, solid ink jet printing systems and various printing or finishing systems where there is an increase the adhesion of a material like ink, glue, decorative coatings and the like, to substrates, such as paper by increasing the surface roughness of the paper.

The substrates resulting with the disclosed processes can be selected for a number of different products depending on the composition of the substrate. Thus, weak acid or weak acid solution exposed substrates can be selected for ceramics, polymers, plastics, and the like. In one aspect, the obtained substrates, such as paper, can be incorporated into a number of suitable ink jet recording apparatuses including solid ink containing apparatuses as disclosed herein, and more specifically, the Xerox Corporation Color Cube Machines and the Xerox Corporation CiPress. Generally, the ink jet recording apparatuses include a recording head having a face on which are formed openings for jetting out or ejecting ink onto the recording surface of the recording medium or ink ejection openings, and an ink ejection face. The Xerox Corporation CiPress when applying the weak acid or weak acid solution to the substrate, such as a smooth coated paper, operates in this instance at a speed of from about 300 to about 500 feet per minute.

Ink Jet Methods

Generally, in ink jet methods, which can have incorporated the treated papers illustrated herein, the recording head jets out ink droplets onto the recording surface of the recording medium through the ink ejection face, the ink droplets being formed, for instance, by the pressure of electromechanical transducers or the heating energy of electro-thermal transducers controlled based on a drive control signal supplied in accordance with image data. In some recording heads, for instance, the ink ejection openings, totaling up to tens to hundreds, are arranged on the ink ejection face with relatively high densities of 400 to 600 dpi for high-quality and high-speed recording. In recent years, studies have been made on a so-called multi-nozzle elongated recording head, in which the ink ejection openings are formed to cover all the recording region of the recording medium, for instance, the entire width thereof, for the purpose of gaining higher recording speed.

Ink jet printing processes that employ inks that are solid at room temperature and liquid at elevated temperatures are known, and can be used with the treated substrates disclosed herein. In these ink jet printing processes, there is provided an apparatus for dispensing solid inks for printing on a substrate such as paper. The ink vehicle is chosen to have a melting point above room temperature so that the ink, which is melted in the apparatus, will not be subject to evaporation or spillage during periods of nonprinting. The vehicle selected possesses a low temperature to permit the use of the solid ink in a thermal ink jet printer. In thermal ink jet printing processes employing these phase-change inks, the solid ink is melted by a heater in the printing apparatus and used as a liquid in a manner similar to that of conventional piezoelectric or thermal ink jet printing. Upon contact with the printing substrate, the molten ink solidifies rapidly enabling the dye to remain on the surface instead of being carried into the paper by capillary action, thereby enabling higher print density than is generally obtained with liquid inks. After the phase-change ink is applied to the substrate, freezing on the substrate resolidifies the ink.

In phase-change printing processes, which can have incorporated the treated papers illustrated herein, the ink undergoes a change with temperature from a solid state to a liquid state in a short period of time, typically in less than about 100 milliseconds. One advantage of phase-change inks is their ability to print superior images on plain paper, since the phase-change ink quickly solidifies as it cools, and, because these inks are primarily waxy in nature, they may not normally soak into a paper medium.

Also, it is believed that the substrates treated in accordance with the disclosed processes may be selected for a number of aqueous ink jet printing methods in which ink droplets are ejected from a nozzle at high speed towards a recording element or medium to produce an image on the medium. The ink droplets, or recording liquid generally comprise a recording agent, such as a dye, and a relatively large amount of solvent in order to prevent clogging of the nozzle. The solvent, or carrier liquid, is typically water and organic material such as monohydric alcohols. An image recorded as liquid droplets requires a receptor on which the recording liquid dries quickly without running or spreading. When images are recorded on a recording paper of the plain paper type with an ink jet printer, a major portion of the ink present on the recording paper permeates into its base paper, and so the extent of print-through, the extent of ink running, the optical density of recorded image, and the color reproducibility of ink are influenced by the base paper constituents. When printing ink is ejected to a pigment coated paper base, feathering can occur and/or the water and ink might penetrate the pigmented coating layer and transfer to the cellulose fibers of the paper support, which will results in loss of image sharpness and density.

Specific embodiments will now be described in detail. These examples are intended to be illustrative, and are not limited to the materials, conditions, or process parameters set forth in these embodiments. All parts are percentages by weight of total solids of all the components unless otherwise indicated.

EXAMPLES

A selection of four popular smooth coated paper stocks of Xerox Digital Color Elite Gloss, Digital Color Elite Silk, Xerox Colotech+ Gloss, and Mohawk Kote Gloss were treated on both surfaces or sides by placing these papers in individual baths of acetic acid at a pH of about 4, and for a period of about 25 milliseconds, followed by the immediate removal of the papers from the bath. The roughness of the papers was assayed before and after treatment, and the results are presented in Table 1 below. The Table 1 paper roughness results were determined by the TAPPI and the Parker Roughness measurement tests, and where the differences in roughness prior to the acetic acid treatment and subsequent to the acetic acid treatment were determined a number of times followed by averaging the individual results.

The Table 1 data shows that as compared to untreated papers for the Xerox Digital Color Elite Gloss paper there was an 18 percent increase in surface roughness; for the Digital Color Elite Silk the surface roughness increased by 81 percent; for the Xerox Colotech+ Gloss paper the surface roughness increased 21 percent, and for the Mohawk Kote Gloss paper the surface roughness increased by 6 percent. In Table 1, nominal means prior to the acetic acid treatment above, and etched means after the above acetic acid treatment; overall refers to the sum of all the averages divided by the number of papers.

TABLE 1

| PAGE SMOOTHNESS NUMBERS | |
|---|---|
| DC Elite Gloss Nominal | Average |
| Smoothness Parker | 1.41 |
| Smoothness TAPPI | 10 |
| DC Elite Gloss Etched | Average |
| Smoothness Parker | 1.665 |
| Smoothness TAPPI | 15 |
| DC Elite Silk Nominal | Average |
| Smoothness Parker | 1.935 |
| Smoothness TAPPI | 22.5 |
| DC Elite Silk Etched | Average |
| Smoothness Parker | 3.5 |
| Smoothness TAPPI | 52 |
| Colotech Gloss Nominal | Average |
| Smoothness Parker | 1.335 |
| Smoothness TAPPI | 10 |
| Colotech Gloss Etched | Average |
| Smoothness Parker | 1.615 |
| Smoothness TAPPI | 17 |
| Mohawk Kote Gloss Nominal | Average |

TABLE 1-continued

| PAGE SMOOTHNESS NUMBERS | | |
|---|---|---|
| Smoothness Parker | 0.905 | |
| Smoothness TAPPI | 8 | |
| Mohawk Kote Gloss Etched | Average | |
| Smoothness Parker | 0.96 | |
| Smoothness TAPPI | 7.5 | |
| Overall | Nominal | Etched |
| Smoothness Parker | 1.39625 | 1.935 |
| Smoothness TAPPI | 12.625 | 22.875 |

Upon microscopic analysis, it was determined that for the above acetic acid treated papers there was roughness on the surface of the coated sheets giving rise to sites where the ink and paper can be intercalated, and thus increasing the image and ink robustness where the printed ink was free of smearing and did not transfer to one's hands after rubbing for 2 to 5 minutes.

Also, to determine surface roughness of treated and untreated papers there can be selected the known Sutherland Rub Test where a four pound weight is placed on the papers and rubbed across the image a number of times, such as 10 times, to visually determine if any of the solid ink rubs off, or if the image is smeared. For the above Table 1, coated papers treated in accordance with the disclosed weak acid processes, no ink was observed on the treated paper, the ink adhered to the coated paper, and there was no image smearing versus the above Table 1 coated papers not treated with a weak acid or weak acid solution, and where solid ink could be seen on the four pound weight placed on the coated paper, and where the image was smeared rendering it unacceptable.

The above treated papers and untreated papers were then incorporated into the Xerox Corporation CiPress solid ink jet printing apparatus, and the ink robustness was determined by hand rubbing the developed images, and where after rubbing for 2 to 5 minutes the ink was free of smearing or being removed from the papers used versus the non-treated acid coated papers where after hand rubbing for about 10 seconds there was image smearing and less image robustness.

While the disclosed treatment processes utilize chemical processes, mechanical methods might also be used to increase the roughness of the coated paper sheets. This might be especially appropriate for papers whose coatings contain no decomposable fillers. Also, the treated coated papers can include an additional second coating or multiple coatings on the surface applied after the treatment to, for example, enhance the gloss characteristics of the paper and for protection.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A process comprising of exposing a smooth coated paper substrate containing fillers to at least one of a weak acid and a weak acid solution consisting of at least one acid and water, wherein the fillers contained in said smooth coated paper substrate subsequent to said weak acid exposing or said weak acid solution exposing are decomposed thereby resulting in a coated paper that possesses roughness characteristics on at least part of the surface thereof and wherein the pH of said weak acid or said weak acid solution is from about 3.1 to about 5.9.

2. A process in accordance with claim 1 wherein said exposing is with said weak acid.

3. A process in accordance with claim 1 wherein said smooth coated paper is exposed on all surfaces thereof.

4. A process in accordance with claim 1 wherein said weak acid is acetic acid that possesses pH of from about 3.5 to about 5.3.

5. A process in accordance with claim 1 wherein said weak acid is selected from the group consisting of at least one of formic acid, trichloroacetic acid, hydrofluoric acid, hydrocyanic acid, acetic acid and oxalic acid.

6. A process in accordance with claim 1 wherein said exposing is accomplished by placing said smooth coated paper substrate in a bath of said at least one of said weak acid and said at least one weak acid solution and where after removal from the bath the coated paper possesses roughness characteristics on at least part of the surface thereof.

7. A process in accordance with claim 6 wherein said coated paper is retained in said bath for a period of from about less than or equal to about one second.

8. A process in accordance with claim 1 wherein said at least one of a weak acid and a weak acid solution is acetic acid, sulfuric acid, hydrochloric acid, or solutions or mixtures thereof.

9. A process in accordance with claim 1 wherein said exposing is accomplished by spraying said weak acid or said weak acid solution onto the substrate, or optionally by applying the weak acid or weak acid solution to the substrate by a blade, by a solid ink jet apparatuses, liquid spray coating, dip coating, wire wound rod coating, fluidized bed coating, air knife, brush, roll, electrostatic spraying, or sonic spraying.

10. A process in accordance with claim 1 where the roughening of the paper surface allows excellent intercalation of a solid ink jet compositions into the roughened paper.

11. A process in accordance with claim 1 wherein the fillers consist of alkali metal salts.

12. A process in accordance with claim 1 wherein the fillers are calcium carbonate, calcium oxide, magnesium carbonate, magnesium oxide, or mixtures thereof.

13. A process in accordance with claim 1 where said coated paper possessing roughness characteristics allows a robust solid ink jet developed image thereon and wherein the solid ink jet ink selected for development is intercalated and retained in said coated paper possessing roughness characteristics.

14. A process in accordance with claim 10 where said coated paper possessing roughness characteristics allows for the transfer of a developed solid ink jet image to said paper, wherein the image and the ink are substantially free of smearing.

15. A process consisting of contacting a smooth coated paper containing fillers with a weak acid, wherein the weak acid is of a pH of from about 3 to about 6, wherein the fillers contained in said smooth coated paper substrate subsequent to said weak acid exposing are decomposed thereby resulting in a coated paper that possesses roughness characteristics on the surface thereof and wherein said roughness characteristics as determined by the TAPPI and the Parker Roughness measurement tests improve by about 6 to about 81 percent as compared to said smooth coated paper that has not been exposed to said weak acid and optionally said paper has formed thereon a solid ink jet ink image with an ink jet composition.

16. A process in accordance with claim 15 wherein the solid ink jet ink image is substantially permanently adhered to said paper, wherein the ink is free of smearing, wherein said weak acid is acetic acid at a pH of from about 3.3 to about 5.5 and wherein said filler is calcium carbonate.

17. A process in accordance with claim 15 wherein said fillers are calcium carbonate fillers and said calcium carbonate fillers contained in said paper degrade or decompose thereby allowing excellent intercalation of said solid ink jet composition into the paper.

18. A process consisting of exposing a smooth coated paper with at a weak acid and wherein said smooth coated paper includes at least one of alkali metal carbonates and alkali metal oxides which degrade or decompose and wherein the pH of said weak acid is from about 3.1 to about 5.9, thereby resulting in a coated paper that possesses roughness characteristics on the surface thereof and wherein said roughnesses characteristics, as determined by the TAPPI and the Parker Roughness measurement tests, are improved from about 6 percent to about 81 percent as compared to said smooth coated paper that has not been exposed to said weak acid.

* * * * *